United States Patent [19]

Joscelyn et al.

[11] 4,306,121

[45] Dec. 15, 1981

[54] ELECTRO-ACOUSTIC TRANSDUCER ASSEMBLY

[75] Inventors: Edwin Joscelyn, Commack; Robert F. Saiya, N. Babylon, both of N.Y.

[73] Assignee: Instrument Systems Corporation, Huntington, N.Y.

[21] Appl. No.: 29,404

[22] Filed: Apr. 12, 1979

[51] Int. Cl.[3] ..... H04R 1/00; H04R 9/06

[52] U.S. Cl. ..... 179/115.5 R; 179/1 PC; 179/1 ST

[58] Field of Search ..... 179/1 ST, 1 G, 1 C, 179/2 C, 107 R, 156 R, 156 A, 157, 1 PC, 146 R, 146 E, 114 R, 117, 115.5 R

[56] References Cited

U.S. PATENT DOCUMENTS

| | | | |
|---|---|---|---|
| Re. 26,030 | 5/1966 | Marchand et al. | 179/115.5 R |
| 2,534,157 | 12/1950 | Zuerker | 179/115.5 R |
| 2,714,134 | 7/1955 | Touger et al. | 179/115.5 R |
| 3,353,625 | 11/1967 | Scanlon | 179/1 PC |
| 3,450,839 | 6/1969 | Scanlon | 179/1 PC |
| 3,463,886 | 8/1969 | Scanlon | 179/1 PC |
| 3,513,270 | 5/1970 | Warning | 179/115.5 R |
| 3,516,151 | 6/1970 | Schneider | 179/115.5 R |
| 3,610,830 | 10/1971 | Daleiden et al. | 179/1 PC |
| 3,772,478 | 11/1973 | McCabe et al. | 179/1 ST |
| 3,925,626 | 12/1975 | Stallings, Jr. | 179/115.5 R |
| 4,055,732 | 10/1977 | Yoshimura et al. | 179/115.5 R |
| 4,075,437 | 2/1978 | Chin et al. | 179/114 R |

*Primary Examiner*—Thomas A. Robinson

*Attorney, Agent, or Firm*—Blum, Kaplan, Friedman, Silberman & Beran

[57] ABSTRACT

A compact electro-acoustic transducer assembly is provided having a housing formed with an acoustic output socket extending longitudinally of the housing and at least one electro-acoustic transducer mounted on the housing in registration with the acoustic output socket. The housing is provided with an aperture for transmission of sound waves from the acoustic output of the transducer to the socket. Conductive leads are deposited on the surface of the housing for providing electrical connection between the transducer and a circuit board supporting the housing. The electrical input terminals to the transducer are surface mounted thereon for engagement against the conductive leads deposited on the housing. The transducer may be formed with a thin plate-like permanent magnet formed of a rare earth cobalt material and supported in a flux-retaining member.

19 Claims, 9 Drawing Figures

ELECTRO-ACOUSTIC TRANSDUCER ASSEMBLY

BACKGROUND OF THE INVENTION

This invention relates to electro-acoustic transducers, and in particular, to electro-acoustic transducers suitable for incorporation in the passenger entertainment systems of vehicles such as aircraft. In such systems, it is customary to provide a control panel having an acoustic output socket capable of receiving an acoustic plug such as the plug 62 illustrated in U.S. Pat. No. 3,772,478. Such plug has a pair of acoustic input tubes adapted for receipt in a corresponding set of acoustic output sockets supported in a control panel mounted, by way of example, on the arm of an airline passenger seat. The arrangement provides stereo entertainment to a user through a stethoscope headset. The control panel is generally provided with both channel selection and volume dials, as well as other switches suitable for use in connection with a passenger service system, such as attendant call switches and light control switches. Also mounted in the control panel are electro-acoustic transducers acoustically coupled to the sockets. Given the limited space available in an airline seat arm, it is important to reduce the size of the electro-acoustic assemblies associated with the acoustic output sockets. Further, it is desirable to minimize cost of production, assembly and maintenance by minimizing the wiring connections required during these steps. By the electro-acoustic transducer assembly in accordance with the invention, a compact, readily assembled structure is provided.

SUMMARY OF THE INVENTION

Generally speaking, in accordance with the invention, an electro-acoustic transducer assembly is provided including a housing, acoustic output socket means mounted in said housing, electro-acoustic transducer means supported on said housing, said housing being formed with an opening for providing acoustic coupling between the acoustic output of said transducer means and the acoustic output socket means, and lead means supported on said housing for providing electrical connection to the electrical input to said transducer means.

Said lead means may be deposited on said housing means for electrical engagement by surface contacts on the electro-acoustic transducer means and for engagement against surface contacts on a circuit board provided for supporting said housing.

The electro-acoustic transducer means may be provided with a plate-like rare earth cobalt permanent magnet polarized in the direction of the thickness thereof and supported in a flux-directing member adapted to define a flux path between the poles of the permanent magnet and for defining a gap in such flux path. Said electro-acoustic transducer means further includes a diaphragm supported on said flux directing member and in turn supporting a coil in said gap for displacement of the diaphragm in response to an input audio signal applied to said coil means.

The coil may be electrically connected to a surface of the transducer means adjacent the audio output thereof as defined by the diaphragm by lead means. Said lead means may include conductive rubber lead means deposited on the interior surface of the diaphragm and extending to the exterior thereof and electrically coupled to the ends of the coil means.

Pin means may be supported by the housing in electrical connection with the lead means for providing connection to a circuit board.

Accordingly, it is an object of the invention to provide an electro-acoustic transducer assembly which is both small in dimension and light in weight.

Another object of the invention is to provide an electro-acoustic transducer assembly which is readily assemblable with a minimum of wiring.

A further object of the invention is to provide an electro-acoustic transducer assembly which may be plug-in mounted in a circuit board for ease of service, and wherein the electro-acoustic transducers may be readily removed without wiring operations, also for ease of service.

Still other objects and advantages of the invention will in part be obvious and will in part be apparent from the specification and drawings.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
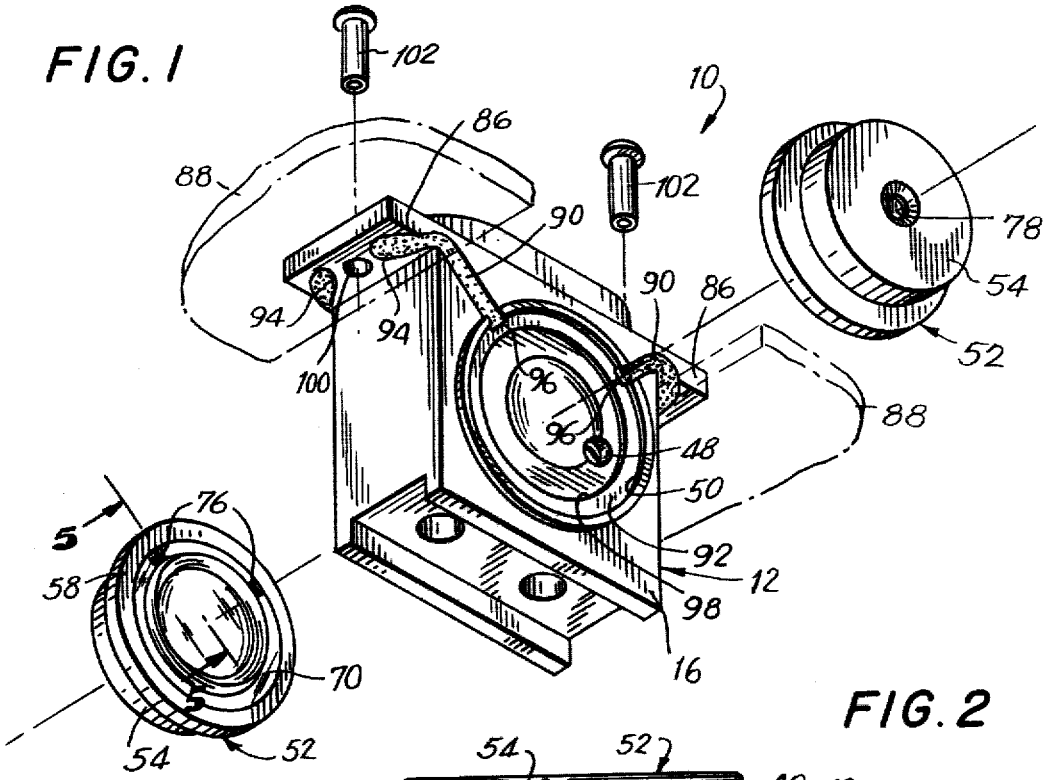
FIG. 1 is an exploded view of a first embodiment of an electro-acoustic transducer assembly in accordance with the invention with the circuit board to which it is to be coupled shown in phantom.
Figure 2:
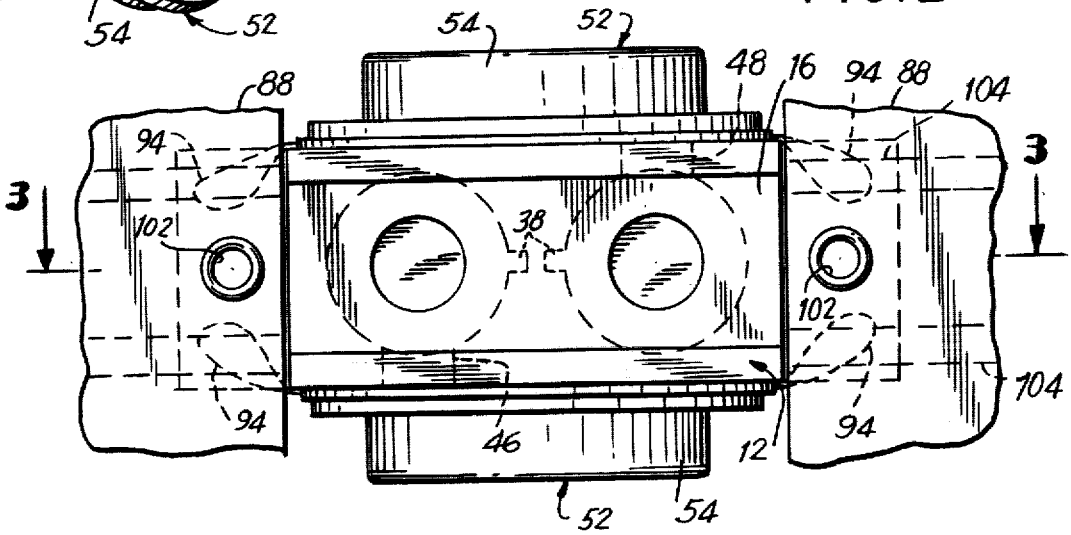
FIG. 2 is a bottom plan view of the electro-acoustic transducer assembly of FIG. 1 mounted on said circuit board.
Figure 3:
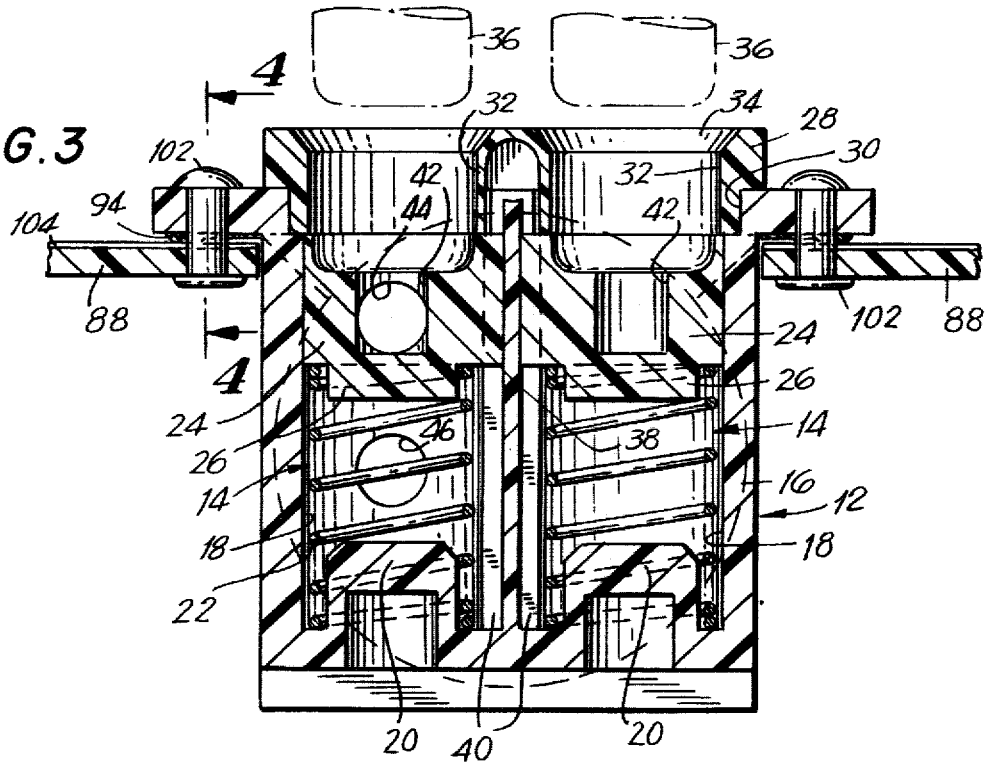
FIG. 3 is a sectional view taken along lines 3—3 of FIG. 2.
Figure 4:
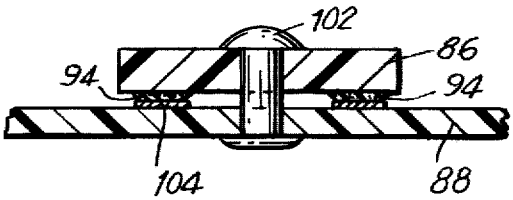
FIG. 4 is a sectional view taken along lines 4—4 of FIG. 3.

The electro-acoustic transducer 10 in accordance with the invention illustrated in FIGS. 1–4 consists of a housing 12 containing a pair of parallel, spaced acoustic output sockets 14 of conventional design. Specifically, housing 12 includes a body 16 formed with a pair of longitudinally extending cylindrical bores 18 therein defining the actual sockets. The bottom of each bore 18 is defined by an upwardly projecting central stop portion 20 which also serves to guide and retain the bottom of a coil spring 22. Each coil spring 22 biases in an upward direction, as viewed in FIG. 3, a displaceable acoustic seal member 24 formed with a downwardly extending projection 26 for receiving and guiding the other end of coil spring 22. The upward displacement, as viewed in FIG. 3, of the acoustic seal members 24 is prevented by a housing top member 28 received in a recess 30 in the top surface of housing body 16. The housing top member 28 is formed with a pair of longitudinally extending apertures 32 therethrough in registration with bores 18 but of a slightly smaller diameter so that the housing top member may define an upper limit to the displacement of the acoustic seal members. As shown in FIG. 3, apertures 32 terminate at their upper end in a chamfer 34 for guiding the sound-conducting prongs 36 (shown in phantom) of the plug of a stethoscope headset, such as the stethoscope headset in U.S. Pat. No. 3,772,478. As shown in FIGS. 2 and 3, each acoustic seal member is formed, on the inner side thereof with a key 38 which rides in a slot 40 formed in housing body 16. The key serves to maintain the orientation of the acoustic seal members.

Each acoustic seal member is formed with an axial bore 42 in the top surface thereof terminating in registration with a laterally extending bore 44 leading to the periphery of the acoustic seal member. The bore 44 in the left acoustic seal member, as viewed in FIG. 3, extends toward one side of housing body 16 while the bore 44 of the right acoustic seal member 24 (not shown) extends to the opposite side of body 16. Body 16 is formed with a laterally extending bore 46 communicating between socket 18 and the exterior of the housing body and positioned for registration with lateral bore 44 of the left acoustic seal member (as viewed in FIG. 3) when said acoustic seal member is displaced downwardly so that projection 26 thereof engages projection 20 at the end of socket 18. A similar bore 48 is formed in the opposite side of housing body 16 for communication with the bore 44 of the right acoustic seal member (as viewed in FIG. 3) when said right acoustic seal member is displaced downwardly. The displacement of the acoustic seal members is effected by the prongs 36 of the plug of the stethoscope headset when manually inserted in the socket. When so inserted, an acoustic path is provided from bore 48 through the bores 44, 42 of the right acoustic seal member 24 (as viewed in FIG. 3) to the corresponding right prong of the plug of the stethoscope headset. Similarly, when displaced downwardly as viewed in FIG. 3, the bore 46 is acoustically coupled to the left prong 36 of the plug through the associated bores 44, 42 of left acoustic seal member 24.

Figure 5:
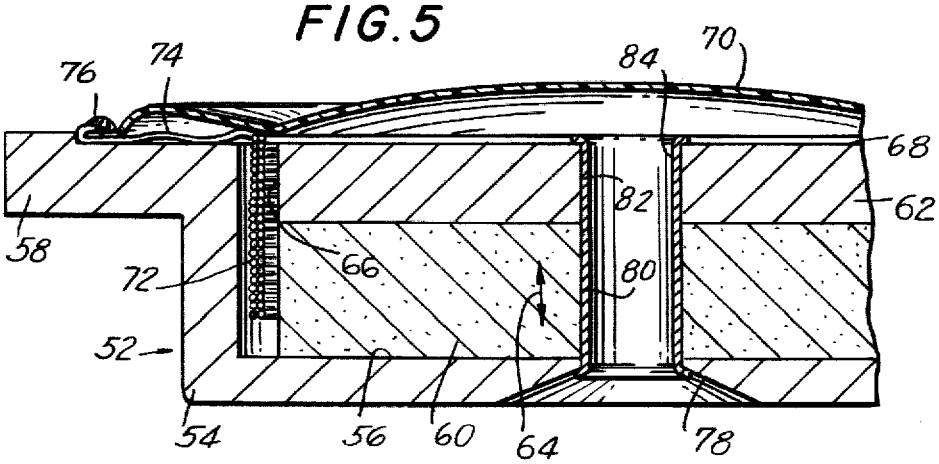
FIG. 5 is an enlarged fragmentary sectional view taken along lines 5—5 of FIG. 1.

As best seen in FIG. 1, each side of housing body 16 is formed with a stepped recess 50 for receiving an electro-acoustic transducer 52. As more particularly shown in FIG. 5, each electro-acoustic transducer 52 includes a cup-member 54 formed with a central well 56 and a laterally extending peripheral flange 58. Centrally received in well 56 is a disc-shaped permanent magnet 60 formed of a rare earth cobalt material such as samarium cobalt. Overlying permanent magnet 60 is a disc-shaped top plate 62. Permanent magnet 60 is polarized in the direction of arrow 64, the direction of its thickness. Top plate 62 and cup-member 54 are formed of a magnetic material such as steel and define a flux path between the poles of permanent magnet 60 which includes an annular gap 66. Supported in a recess 68 in the top surface of cup-member 52 is a diaphragm 70, said diaphragm being supported at its periphery and being free to vibrate in the central region thereof. Supported by the vibrating central region of diaphragm 70 is an annular coil 72 which projects into gap 66 for oscillatory displacement in said gap for the purpose of vibrating diaphragm 70 to create sound waves. The central region of diaphragm 70 serves as the acoustic output of the electro-acoustic transducer 52. The electrical connection to coil 72 is by leads 74 (of which only one is shown), each of which extends about the periphery of diaphragm 70 to a position on the outer surface thereof at which a contact terminal 76 is formed as by solder.

Each of cup-member 54, permanent magnet 60 and top plate 62 are formed with respective central apertures 78, 80 and 82. These components are held together by a rivet 84 stacked at its opposed ends and formed of a non-magnetic material. Housing body 16 is formed with a pair of laterally projecting wings 86 for mounting of the assembly to a circuit board such as circuit board 88. Deposited on the surface of housing body 16 are leads 90, each lead extending from a point on shelf 92 defined in one of recesses 50, to the underside of a wing 85 at which point a contact region 94 of said lead is formed. The end 96 of each lead 90 is positioned for engagement by a contact 76 of the electro-acoustic transducer for the application of the audio signal to the coil for the purpose of driving the transducer. Lead 90 is disposed in a channel in the surface of housing 16 at least in the region inward of end 96 to avoid short circuiting of the lead against flange 58 of cup-member 54. Shelf 92 defines a deeper region 98 of recess 50 to define a sound chamber within which the central region of diaphragm 70 vibrates and in communication with bore 48 for the transmission of sound waves therethrough. Each wing 86 of housing body 16 is formed with an aperture 100 therethrough for the passage of a rivet 102, to couple the transducer assembly to a circuit board 88. The top surface of circuit board 88 would be provided with conductive leads 104 for engagement by the contact portions 94 of leads 90 to provide electrical connection between the transducer assembly and the circuit board as more particularly shown in FIG. 4. The conductive leads 90 may be formed of a conductive rubber material which can be readily applied to the irregular surfaces of housing 16 yet may provide a reliable electrical conductive path.

By the foregoing construction, each of the electro-acoustic transducers 52 may be readily releasably mounted in a recess 50 of housing body 16 without the requirement of wiring and may be secured therein by any desired mechanism such as adhesive or a securing strap (not shown). Since no soldering is required, the replacement of the transducer is readily achieved. Likewise, the entire assembly may be readily mounted to the circuit board, again without soldering.

Figure 6:
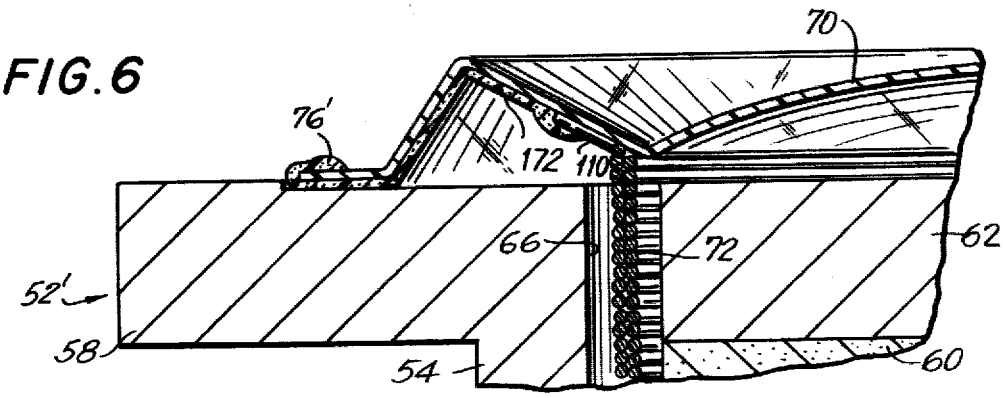
FIG. 6 is a fragmentary sectional view of an alternate embodiment of an electro-acoustic transducer in accordance with the invention.

Referring to FIG. 6, an alternate construction of the electro-acoustic transducer 52' in accordance with the invention is depicted, like reference numerals being applied to like elements. The embodiment of FIG. 6 differs from the embodiment of FIG. 5 in that each end 110 (of which only one is shown) of coil 72 is coupled to the exterior surface of the periphery of diaphragm 70 by a conductive rubber lead 172 which also defines contact 76'. The conductive rubber lead 172, because of its resiliency, can survive the strain of the vibration of the diaphragm without strain hardening, presenting a more reliable lead connection. Lead 172 is insulated where required.

Figure 7:
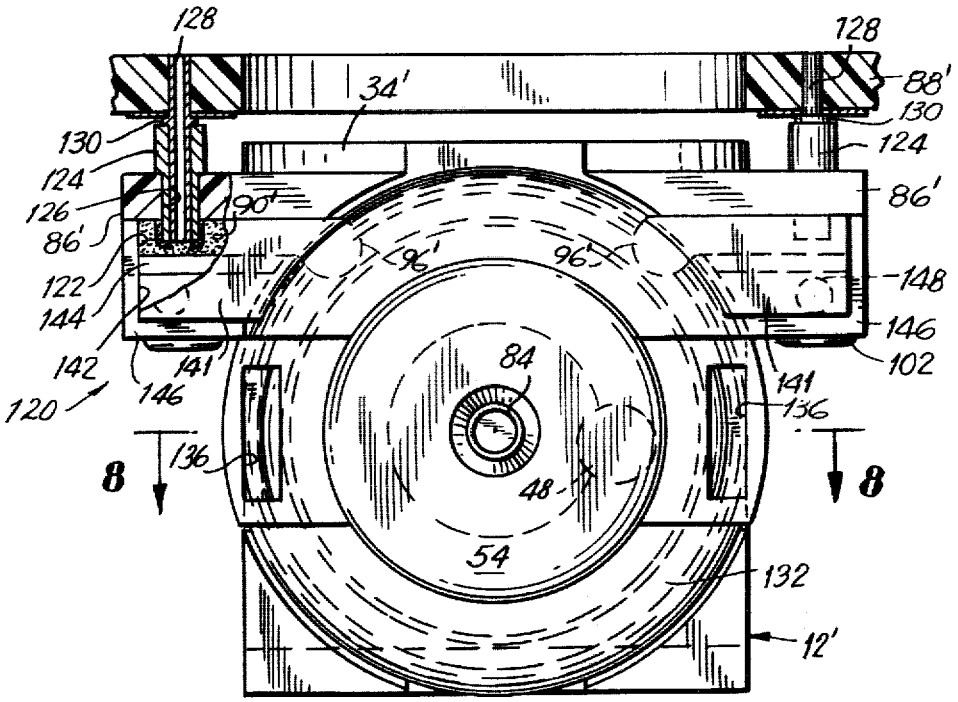
FIG. 7 is a side elevational view of a second embodiment of the electro-acoustic transducer in accordance with the invention.
Figure 8:
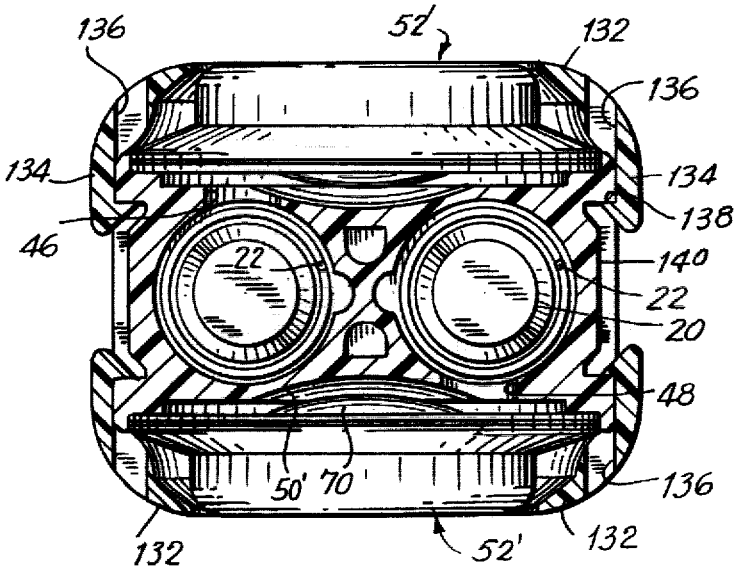
FIG. 8 is a sectional view taken along lines 8—8 of FIG. 7.
Figure 9:
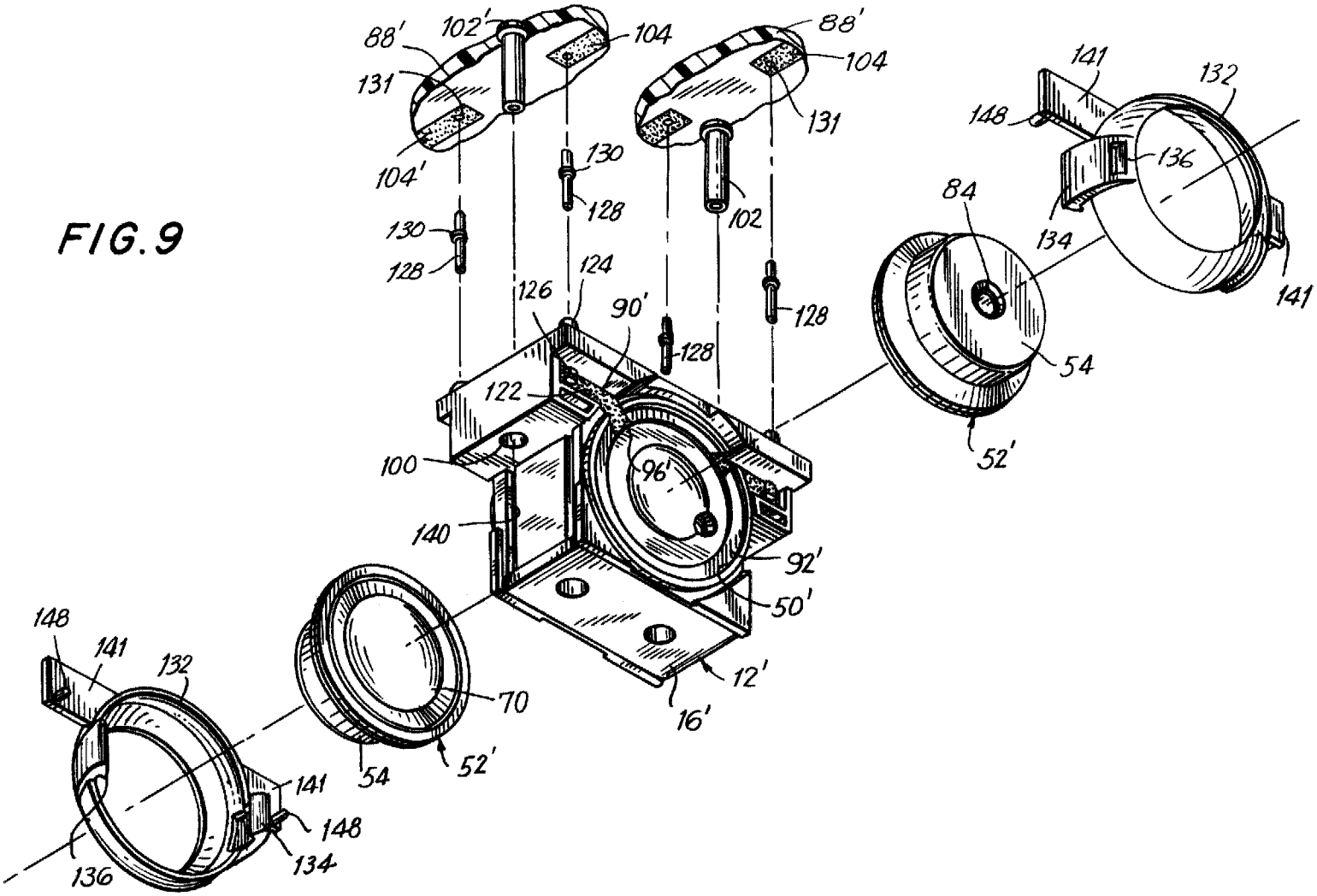
FIG. 9 is an exploded view of the electro-acoustic transducer assembly of FIGS. 7 and 8.

Referring to FIGS. 7, 8 and 9, a second embodiment 120 of the electro-acoustic transducer in accordance with the invention is depicted. Like reference numerals are applied to equivalent components in the embodiment of FIGS. 1-5, the reference numerals for equivalent components being prime where they vary in shape as described. Housing 12' contains a pair of acoustic output sockets as described above. Wings 86' have been thickened in the longitudinal direction of the housing and the front surface thereof is formed with a channel 122 on each side thereof communicating to shelf 92' in each recess 50' for receiving a conductive lead 90' having a contact 96' at one side thereof. Each side of each wind 86' of housing 12' is formed with a blind hole 126 in the top surface thereof extending into the region of channel 122. Each blind hole 126 is positioned so that a pin socket 124 received therein has a portion thereof which projects into the channel 122 for engagement with the associated conductive lead 90' to provide an electrical connection therebetween. Each of the pin sockets 124 project upwardly from its associated wing to a position above the level of top housing member 34' and receives a coupling pin 128. Coupling pin 128 has a portion which is captured in pin socket 124, an annular rib portion 130 and a portion which projects upwardly from said annular rib portion to define a coupling pin. Each transducer assembly would be provided with at least four such coupling pins, providing two electrical connections to each transducer. The pins would be adapted for receipt in corresponding apertures 131 in circuit board 88' with annular rib 130 making electrical connection with a conductive lead 104' on the surface of said circuit board. If desired, a securing means such as rivet 102' may be provided for retaining the transducer assembly in position. In the alternative, screws, bolts or other releasable mountings may be utilized, or the frictional force of the pins may be relied upon. The pin construction described permits the releasable mounting of a transducer assembly for ease of servicing and construction. The respective electro-acoustic transducers 52' are retained in recess 50 by means of respective snap covers 132. Each snap cover 132 is provided with a pair of spring fingers 134, the resiliency of which is provided by apertures 136. Each spring finger has a lip 138 at the end thereof for retention in a longitudinally extending slot 140 formed in the ends of housing body 16' between the bottom of wings 86' and the bottom of said housing body. Snap cover 132 permits the ready replacement of the respective electro-acoustic transducer 52' while normally retaining same in position and protecting same from damage. Each snap cover 132 is provided with a pair of laterally extending wings 141 which overlie the sides of wings 86' to cover channel 122 and to provide protection to the conductive leads 90'. Each side of each wing 86' is also provided with a channel 142 below channel 122 and separated therefrom by a rib 144, the top surface of which is recessed relative to the rim 146 of each side of each wing 86'. Each wing 141 of snap cover 132 is formed with a pin 148 which is received in the associated channel 142 for support of the associated snap cover wing, each said wing being received in the recess defined by the top surface of rib 144 and the periphery of rim 146 so as to present an essentially flat exterior surface.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electro-acoustic transducer assembly comprising housing means; acoustic output socket means extending longitudinally in said housing means; electro-acoustic transducer means supported on said housing means, said housing means being formed with an opening for providing acoustic coupling between the acoustic output of said transducer means and said acoustic output socket means, said electro-acoustic transducer means being formed with surface contact means defining the electrical input to said transducer means; and conductive means supported on said housing, a portion of each of said conductive means being in registration with said surface contact means of said transducer means for engagement thereby when said transducer means is supported on said housing means, another portion of each said conductive means defining an electrical input terminal to said transducer assembly.

2. The electro-acoustic transducer assembly as recited in claim 1, wherein at least a portion of said conductive means is formed of a conductive rubber material deposited on the surface of said housing means.

3. The electro-acoustic transducer assembly as recited in claim 2, wherein said conductive rubber portion of said electro-acoustic transducer means includes a region engaged by the surface contact means defining the electrical input to said electro-acoustic transducer means.

4. The electro-acoustic transducer assembly as recited in claim 3, wherein said housing means is formed with at least one laterally extending wing for the support of said electro-acoustic transducer assembly, said conductive rubber portion of said conductive means extending to a surface of said wing.

5. The electro-acoustic transducer assembly as recited in claim 4, wherein the portion of said conductive rubber on the surface of said wing defines an electrical input contact for said transducer assembly.

6. The electro-acoustic transducer assembly as recited in claims 1, 2 or 3 wherein said conductive means includes a projecting contact pin supported on said housing and defining an electrical input terminal, whereby said transducer assembly may be releasably mounted by means of said projecting contact pin to a circuit board for electrical contact thereto and support thereby.

7. An electro-acoustic transducer assembly as recited in claim 6, wherein said housing means includes a pair of laterally extending wings, and including at least one of said projecting pins extending in the same direction from each of said wings.

8. The electro-acoustic transducer means as recited in claim 7, wherein said contact pins project from a top surface of said housing means, a side surface of each of said wings being formed with a channel into which said conductive pin extends, a portion of said conductive means extending in said channel.

9. The electro-acoustic transducer means as recited in claim 8, including cover means for covering said channel to provide protection to said conductive means.

10. The electro-acoustic transducer assembly as recited in claim 1, wherein said electro-acoustic transducer includes a thin plate-like permanent magnet formed of a rare earth cobalt material and polarized in the direction of its thickness; flux-retaining means for receiving and substantially surrounding said permanent magnet and defining a magnetic flux path including a gap between the poles thereof; a diaphragm defining the acoustic output of said transducer means; and coil means mounted on said diaphragm for the vibration thereof and projecting into said gap.

11. The electro-acoustic transducer assembly as recited in claim 10, wherein said permanent magnet is formed of samarium cobalt.

12. The electro-acoustic transducer assembly as recited in claim 10 or 11 wherein said housing is formed with a region defining a sound chamber on a side thereof extending substantially over a length of said acoustic output socket means and communicating with said aperture in said housing means, said electro-acoustic transducer means being supported on said housing means overlying said sound chamber with the acoustic output portion of said diaphragm in said sound chamber for the transmission of sound waves to said acoustic output socket.

13. The electro-acoustic transducer assembly as recited in claim 12, including a pair of acoustic output socket means, an aperture and a sound chamber region on each side of said housing, each said aperture and associated sound chamber region being connected to one of said acoustic output socket means, and one of said electro-acoustic transducer means supported in each of said sound chamber regions, at least four of said conductive means supported on said housing means, each of said transducer means including at least two surface contacts for engagement of respective conductive means.

14. An electro-acoustic transducer assembly as recited in claim 13, including releasable cover means for retaining each such electro-acoustic transducer means in position against said housing means.

15. The electro-acoustic transducer assembly as recited in claims 10 or 11, including conductive rubber lead means extending along the undersurface of said diaphragm means and around the edge thereof for providing electrical connection between said surface contact of said electro-acoustic transducer means and said coil.

16. An electro-acoustic transducer assembly comprising housing means; acoustic output socket means extending longitudinally in said housing means; and electro-acoustic transducer means supported on said housing means, said electro-acoustic transducer means including a thin plate-like permanent magnet formed of a rare earth cobalt material and polarized in the direction of its thickness, flux-retaining means for receiving and substantially surrounding said permanent magnet and defining a magnetic flux path including a gap between the poles of said permanent magnet, a diaphragm defining the acoustic output of said transducer means, and coil means mounted on said diaphragm for the vibration thereof and projecting into said gap.

17. The electro-acoustic transducer assembly as recited in claim 16, wherein said permanent magnet means is formed from samarium cobalt.

18. The electro-acoustic transducer assembly as recited in claims 16 or 17, wherein said flux-retaining means includes a cup-member formed with a well for receiving said permanent magnet and a top plate overlying said permanent magnet, said gap being defined between the periphery of said top plate and the inner periphery of said well.

19. The electro-acoustic transducer assembly as recited in claims 16 or 17, including conductive rubber contact means extending along the undersurface of said diaphragm to the outer surface thereof and electrically coupled to said coil for defining an input electrical contact for said electro-acoustic transducer means.

* * * * *